US009404378B2

(12) United States Patent
Johns et al.

(10) Patent No.: US 9,404,378 B2
(45) Date of Patent: Aug. 2, 2016

(54) ROTATING SEAL CONFIGURATION AND METHOD OF SEALING A ROTATING MEMBER TO A HOUSING

(71) Applicant: General Electric Company, Schenectady, NY (US)

(72) Inventors: David Richard Johns, Simpsonville, SC (US); Eric David Roush, Greer, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 14/881,765

(22) Filed: Oct. 13, 2015

(65) Prior Publication Data

US 2016/0032752 A1 Feb. 4, 2016

Related U.S. Application Data

(63) Continuation of application No. 13/676,637, filed on Nov. 14, 2012, now Pat. No. 9,194,247.

(51) Int. Cl.

| | |
|---|---|
| ***F01D 5/20*** | (2006.01) |
| ***F01D 11/02*** | (2006.01) |
| ***F01D 11/08*** | (2006.01) |
| ***F01D 25/24*** | (2006.01) |

(52) U.S. Cl.

CPC ..... *F01D 11/02* (2013.01); *F01D 11/08* (2013.01); *F01D 25/24* (2013.01); *F05D 2220/32* (2013.01); *F05D 2240/55* (2013.01)

(58) Field of Classification Search

CPC ..... F01D 11/02; F01D 11/08; F01D 11/12; F01D 11/122; F01D 11/127

USPC ..... 415/173.5

See application file for complete search history.

(56) References Cited

U.S. PATENT DOCUMENTS

| | | | |
|---|---|---|---|
| 6,652,226 | B2 | 11/2003 | Albrecht, Jr. et al. |
| 6,913,445 | B1 | 7/2005 | Beddard et al. |
| 7,686,568 | B2 | 3/2010 | Moors et al. |
| 2007/0285110 | A1 | 12/2007 | Nigmatulin et al. |
| 2011/0052384 | A1 | 3/2011 | Shi et al. |

FOREIGN PATENT DOCUMENTS

| | | | | |
|---|---|---|---|---|
| WO | 2005061854 | A1 | 7/2005 | |
| WO | WO 2005061854 | A1 * | 7/2005 | ..... F01D 5/225 |

OTHER PUBLICATIONS

Mikus, Non-Final Office Action for U.S. Appl. No. 13/676,637, Dated Mar. 19, 2015, 19 Pages.

(Continued)

*Primary Examiner* — Dwayne J White

*Assistant Examiner* — Jason Mikus

(74) *Attorney, Agent, or Firm* — Ernest G. Cusick; Hoffman Warnick LLC

(57) ABSTRACT

A seal configuration includes a housing and a rotatable member rotationally mounted relative to the housing. The rotatable member has at least one portion defining an outer perimetrical face that is configured to contact the housing during operational conditions that cause a radial dimension of the at least one portion to increase. The at least one portion has opposing axial surfaces with each of the opposing axial surfaces being dimensionally axially nearer to the other of the opposing axial surfaces immediately radially inwardly of the outer perimetrical face than a furthest part of the outer perimetrical face.

18 Claims, 3 Drawing Sheets

(56) References Cited
OTHER PUBLICATIONS

Mikus, Final Office Action for U.S. Appl. No. 13/676,637, Dated Jul. 2, 2015, 10 Pages.

Mikus, Notice of Allowance for U.S. Appl. No. 13/676,637, Dated Sep. 22, 2015, 8 Pages.

* cited by examiner

ROTATING SEAL CONFIGURATION AND METHOD OF SEALING A ROTATING MEMBER TO A HOUSING

BACKGROUND OF THE INVENTION

The subject matter disclosed herein relates to configurations that seal a rotating member to a housing and more specifically to sealing an outermost radial portion of the rotating member to the housing. Sealing components that move relative to one another create challenges. These challenges are exacerbated when clearance between the moving components is altered based upon operational conditions of the machine as happens between a shroud of a bucket and a casing of a turbine engine, for example. Industries that rely on such seals are therefore receptive to new systems and methods that improve sealing between parts moving relative to one another.

BRIEF DESCRIPTION OF THE INVENTION

According to one aspect of the invention a rotating seal configuration includes a housing and a rotatable member rotationally mounted relative to the housing. The rotatable member has at least one portion defining an outer perimetrical face that is configured to contact the housing during operational conditions that cause a radial dimension of the at least one portion to increase. The at least one portion has opposing axial surfaces with each of the opposing axial surfaces being dimensionally axially nearer to the other of the opposing axial surfaces immediately radially inwardly of the outer perimetrical face than a furthest part of the outer perimetrical face.

According to another aspect of the invention a method of sealing a rotatable member to a housing includes rotating a rotatable member relative to a housing, contacting the housing with a portion of the rotatable member and cutting a groove in the housing with the portion while preventing contact between either of opposing axial surfaces of the portion and the housing.

According to another aspect of the invention a turbomachine component includes a rotatable member rotationally mounted relative to a housing. The turbomachine component has a portion defining an outer perimetrical face being configured to contact the housing during some operational conditions, the portion has opposing axial surfaces that are axially nearer to one another at positions radially inwardly of the outer perimetrical face than they are at the outer perimetrical face.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
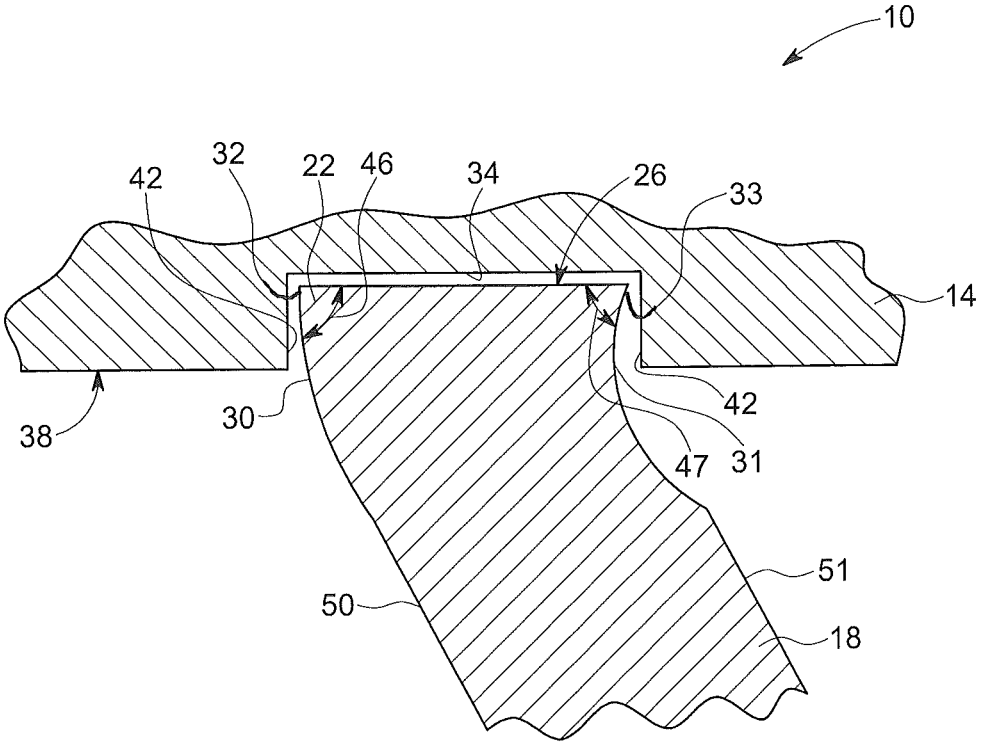
FIG. 1 depicts a cross sectional view of an embodiment of a rotating seal configuration disclosed herein.

Referring to FIG. 1, an embodiment of a rotating seal configuration disclosed herein is illustrated at 10. The rotating seal configuration 10 includes a substantially stationary housing 14 and a rotatable member 18 that is configured to rotate relative to the housing 14. The rotatable member 18 has a portion 22 with an outer perimetrical face 26 located at the greatest radial dimensions thereof The outer perimetrical face 26 is configured to interferingly contact the housing 14 during certain operational conditions of a machine that incorporates the housing 14 and the rotatable member 18. The portion 22 has opposing axial surfaces 30, 31 positioned immediately radially inwardly of the outer perimetrical face 26. The rotating seal configuration 10 is configured such that one or both of the opposing axial surfaces 30, 31 is axially nearer to the other of the opposing axial surfaces 30, 31 immediately radially inwardly of the outer perimetrical face 26 than a furthest part 32, 33 of the outer perimetrical face 26.

Contact between the portion 22 and the housing 14 while the rotatable member 18 is rotating causes the portion 22 to cut into the housing 14 thereby cutting an annular groove 34 into an inner radial surface 38 of the housing 14. The cutting of the groove 34 assures that annular clearance between the outer perimetrical face 26 and the housing 14 is reduced thereby forming a dynamic seal therebetween. Materials for the housing 14 and the portion 22 may be chosen to assure that more material is removed from the housing 14 than from the rotatable member 18 during cutting. In turbine engine applications, for example, the housing 14 is often made of thin metal sheets in the shape of honeycomb cells while the rotatable member 18 is fabricated of much thicker metal. As such the honeycomb housing 14 is sacrificial and is easily cut away by the rotatable member 18 when the portion 22 comes into contact therewith. The portion 22 in a turbine engine may be part of a shroud of a bucket or one of two or more teeth in a labyrinth seal of a rotor while the housing may be a stationary outer assembly of the turbine engine or another rotatable part that rotates at a different speed than that of the portion 22, for example.

Making the opposing axial surfaces 30, 31 nearer to one another immediately radially inwardly of the outer perimetrical face 26 than a furthest part 32, 33 of the rotating seal configuration 10 assures that the opposing axial surfaces 30, 31 do not come into contact with sides 42 of the groove 34. Such contact, if allowed to occur could have detrimental operational effects related to frictional engagement, heating and removal of additional material from either the housing 14 or the rotatable member 18 beyond that which is necessary, for example.

If the interference contact between the portion 22 and the housing 14 is due to radial growth only of the rotatable member 18 the sides 42 will be substantially orthogonal to a rotational axis of the rotatable member 18. If there is some longitudinal movement combined with the radial growth of the rotatable member 18 the sides 42 may have a frustoconical or even a curved conical shape. If a longitudinal component of motion is anticipated then the opposing axial surfaces 30, 31 can be made to recede axially a sufficient amount to assure they do not contact the housing 14 when cutting thereinto. It should be noted that the interference contact between the portion 22 and the housing 14 can also be due to a reduction in radial dimension of the housing 14.

Angles 46 and 47 are defined between the outer perimetrical face 26 and the opposing axial surfaces 30, 31 respectively. In the embodiment illustrated the outer perimetrical face 26 is parallel to a rotational axis of the rotatable member 18 (it should be noted, however, that outer perimetrical surfaces that are not parallel to the rotational axis of the rotatable member 18 are also possible). The angles 46 and 47 are less than 90 degrees and are therefore acute angles. Since the rotatable member 18 in FIG. 1 is tilted, for example, and is not perpendicular to a rotational axis of the rotatable member 18, sides 50, 51 thereof are also tilted. As such, the opposing axial surface 30 can simply be an extension of the side 50 thereby defining a portion of the acute angle 46. However, if the opposing axial surface 31 were simply an extension of the side 51 then the angle 47 would be obtuse and would measure greater than 90 degrees. Opposing axial surface 31 is therefore not an extension of the side 51 but instead is a recess in the portion 22 between the side 51 and the outer perimetrical surface 26. Since the opposing axial surface 31 is a recess it can be made in the rotatable member 18 by removal of material from the rotatable member 18, which is easier to fabricate than adding material to a rotatable member as is typically done.

Figure 2:
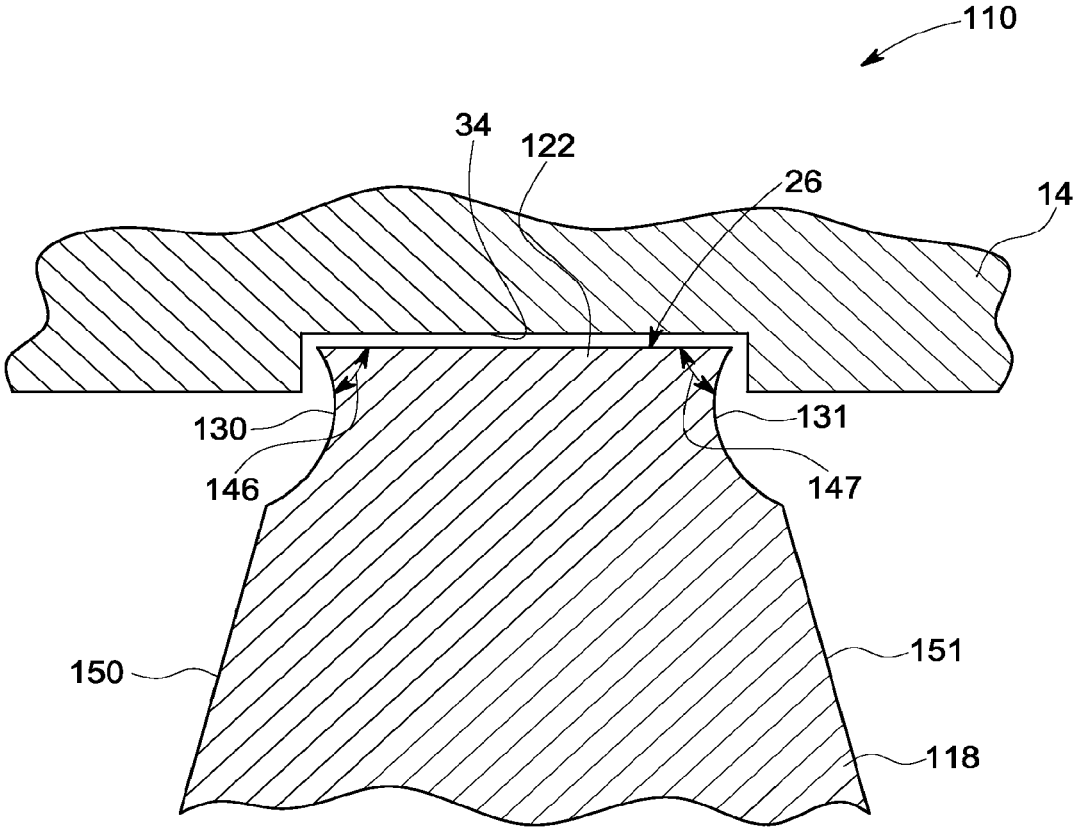
FIG. 2 depicts a cross sectional view of an alternate embodiment of a rotating seal configuration disclosed herein.

Referring to FIG. 2, an alternate embodiment of a rotating seal configuration disclosed herein is illustrated at 110. The configuration 110 is similar to the configuration 10 and as such similar features are numbered alike and only differences will be described in detail hereunder. The rotatable member 118 of the rotating seal configuration 110 has sides 150, 151 that taper together toward the outer perimetrical surface 26. As such, both opposing axial surfaces 130, 131 are defined by recesses formed in the sides 150, 151 at a portion 122 of rotatable member 118 near the outer perimetrical surface 26, thereby defining acute angles 146, 147 respectively.

Figure 3:
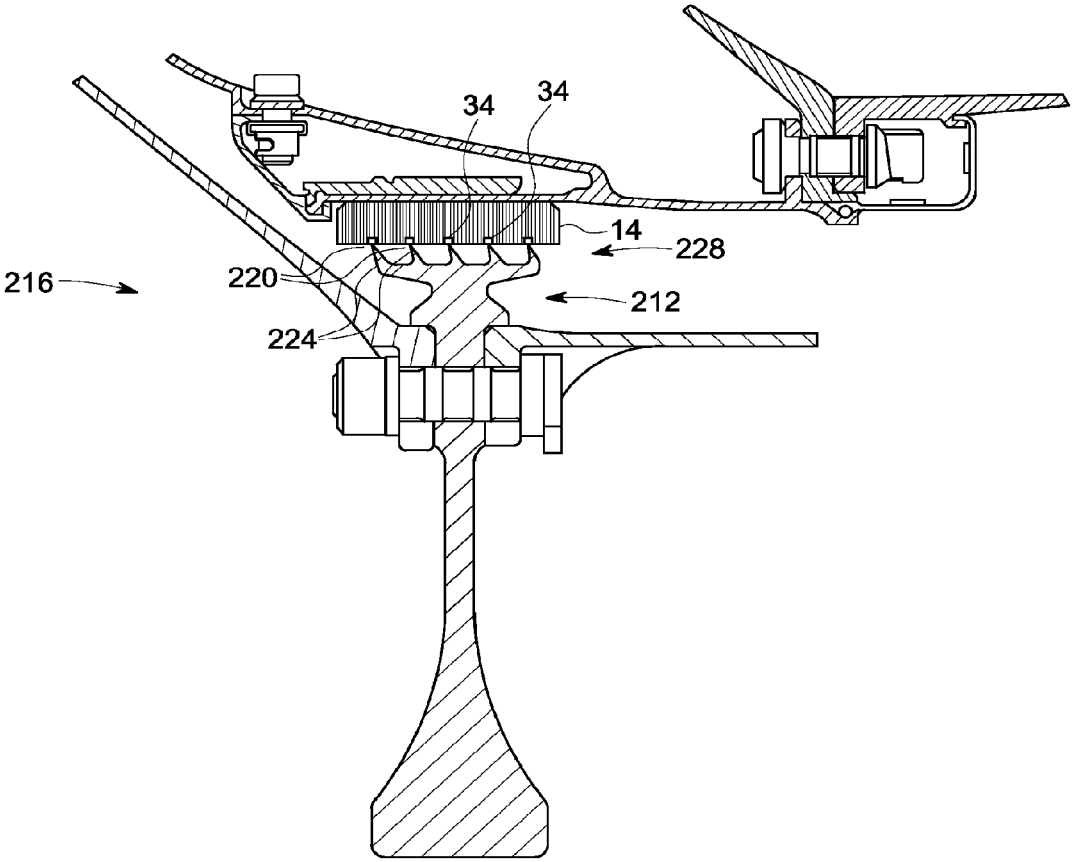
FIG. 3 depicts a partial cross sectional view of a turbine engine employing a plurality of the rotating seal configurations of FIG. 1 or 2.

Referring to FIG. 3, a portion 212 of a turbine engine 216 employing the rotating seal configuration 10, 110 disclosed herein. The portion 212 can be any rotating portion 212 of the turbine engine 216 including but not limited to rotational portions of a compressor section or a turbine section. The portion 212 includes a plurality of the rotating seal configurations 10, 110 with one configuration 10, 110 each being illustrated on an end 220 of one of five teeth 224. Together the plurality of rotating seal configurations 10, 110 form a labyrinth seal 228 since each of the teeth 224 form one of the grooves 34 in the housing 14.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A rotating seal configuration, comprising:

a housing; and a rotatable member rotationally mounted relative to the housing having at least one portion defining an outer perimetrical face being configured to contact the housing during some operational conditions, the at least one portion having opposing axial surfaces with at least one of the opposing axial surfaces being dimensionally axially nearer to the other of the opposing axial surfaces immediately radially inwardly of the outer perimetrical face than a furthest part of the outer perimetrical face, wherein the portion includes a recess having an apex extending axially inwardly relative to at least one of the opposing axial surfaces, the rotatable member having an acute angle between the outer perimetrical face and the recess radially outboard of the apex, and the rotatable member having an obtuse angle between the recess and the at least one of the opposing axial surfaces radially inboard of the apex wherein said recess spans less than a length of the at least one of the opposing axial surfaces.

2. The rotating seal configuration of claim 1, wherein the outer perimetrical face is oriented substantially parallel to a rotational axis of the rotatable member.

3. The rotating seal configuration of claim 1, wherein the outer perimetrical face cuts into the housing in response to contact therewith while the rotatable member is rotating.

4. The rotating seal configuration of claim 1, wherein the rotating seal configuration is configured such that neither of the opposing axial surfaces make contact with the housing after the rotatable member has cut a groove into the housing.

5. The rotating seal configuration of claim 1, wherein the at least one portion is a plurality of the at least one portion that together form a labyrinth seal with grooves cut into the housing.

6. The rotating seal configuration of claim 1, wherein the at least one portion is a labyrinth seal of a turbine engine.

7. The rotating seal configuration of claim 1, wherein the at least one portion is part of a shroud of a turbine bucket.

8. The rotating seal configuration of claim 1, wherein the housing has a honeycomb structure.

9. The rotating seal configuration of claim 1, wherein greatest radial dimensions of the at least one portion define the outer perimetrical face.

10. The rotating seal configuration of claim 1, wherein at least one of the opposing axial surfaces is formable by removal of material from a side of the rotatable member.

11. The rotating seal configuration of claim 1, wherein a radial dimension of the at least one portion increases during some operational conditions.

12. A turbomachine component, comprising a rotatable member rotationally mounted relative to a housing having at least one portion defining an outer perimetrical face being configured to contact the housing during some operational conditions, the at least one portion having opposing axial surfaces that are axially nearer to one another at positions radially inwardly of the outer perimetrical face than they are at the outer perimetrical face, wherein the portion includes a recess having an apex extending axially inwardly relative to at least one of the opposing axial surfaces, the rotatable member having an acute angle between the outer perimetrical face and the recess radially outboard of the apex, and the rotatable member having an obtuse angle between the recess and the at least one of the opposing axial surfaces radially inboard of the apex wherein said recess spans less than a length of the at least one of the opposing axial surfaces.

13. The turbo machine component of claim 12, wherein the turbomachine component is employed in a turbine engine.

14. The turbo machine component of claim 13, wherein turbomachine component is part of a compressor section of the turbine engine.

15. The turbo machine component of claim 13, wherein turbomachine component is part of a turbine section of the turbine engine.

16. The turbo machine component of claim 12, wherein the at least one portion is a plurality of portions.

17. The turbo machine component of claim 16, wherein each of the plurality of portions forms a groove in the housing.

18. The turbo machine component of claim 17, wherein the plurality of portions and the plurality of grooves together form a labyrinth seal.

* * * * *